US006584923B2

(12) United States Patent
Le Lan et al.

(10) Patent No.: US 6,584,923 B2
(45) Date of Patent: Jul. 1, 2003

(54) AUTONOMOUS CONTAINER SHIP WITH HULL INCORPORATING A PROPULSION SYSTEM

(75) Inventors: Jean-Yves Le Lan, Ploemeur (FR); Olivier De Smirnoff, Port Louis (FR); Daniel Person, Coueron (FR); Christian Gilles Fournier, Issy-les-Moulineaux (FR)

(73) Assignee: Etat Francais represente par le Delegue General pour l'Armament, Armees (FR)

( * ) Notice: Subject to any disclaimer, the term of this patent is extended or adjusted under 35 U.S.C. 154(b) by 0 days.

(21) Appl. No.: 09/202,986

(22) PCT Filed: Apr. 27, 1998

(86) PCT No.: PCT/FR98/00839

§ 371 (c)(1),
(2), (4) Date: Feb. 2, 1999

(87) PCT Pub. No.: WO98/49051

PCT Pub. Date: Nov. 5, 1998

(65) Prior Publication Data

US 2001/0054372 A1 Dec. 27, 2001

(30) Foreign Application Priority Data

Apr. 29, 1997 (FR) ..... 97 05252

(51) Int. Cl.[7] ..... B63B 25/00
(52) U.S. Cl. ..... 114/72
(58) Field of Search ..... 114/72–75, 61.1, 114/63, 62, 61.27, 61.29, 61.32, 56.1; 440/6

(56) References Cited

U.S. PATENT DOCUMENTS

| | | | | |
|---|---|---|---|---|
| 1,717,255 A | * | 6/1929 | Pollack | 440/6 |
| 3,162,169 A | * | 12/1964 | Ferris | 114/72 |
| 3,397,664 A | | 8/1968 | Slager et al. | |
| 3,426,717 A | * | 2/1969 | Oskolsky et al. | 114/62 |
| 3,450,090 A | * | 6/1969 | Best, Jr. | 114/62 |
| 3,587,505 A | * | 6/1971 | Wells | 114/72 |
| 3,591,023 A | | 7/1971 | Allen | |
| 3,934,531 A | * | 1/1976 | Allen | 114/72 |
| 3,977,352 A | | 8/1976 | Pran et al. | |
| 4,043,285 A | * | 8/1977 | Nordstrom | 114/72 |
| 4,371,350 A | | 2/1983 | Kruppa et al. | |
| 4,495,880 A | | 1/1985 | Maniscalco et al. | |
| 5,038,696 A | | 8/1991 | Athanasiou et al. | |

FOREIGN PATENT DOCUMENTS

| | | |
|---|---|---|
| BE | 811 668 A | 6/1974 |
| BE | 811 669 A | 6/1974 |
| BE | 811 670 A | 6/1974 |
| EP | 0 497 748 A | 8/1992 |
| EP | 0 703 139 A1 | 3/1996 |
| FR | 2133290 | 11/1972 |
| FR | 2579951 A | 10/1986 |
| FR | 2597825 A | 10/1987 |

OTHER PUBLICATIONS

*Jane's Intermodal Transportation,* pp. 315, 338 and 341.

* cited by examiner

*Primary Examiner*—Edwin Swinehart
(74) *Attorney, Agent, or Firm*—Oliff & Berridge, PLC

(57) ABSTRACT

The invention concerns an autonomous container ship comprising a bottom, a propulsion system, a loading and unloading system for loading and unloading containers, a balancing system, characterized in that the bottom has a hull incorporating a propulsion system and the ship comprises a carrying system for transporting containers from important ports equipped with facilities for loading and unloading containers to small ports not provided with such equipment and less than 4 meters deep. The ship includes a propulsion system ensuring the ship's cruising speed on the high seas and its speed in estuaries and ports, a loading and unloading system adapted to ports not provided with appropriate equipment, and a balancing system for balancing the ship at sea providing stability and trim during container handling operations.

18 Claims, 2 Drawing Sheets

AUTONOMOUS CONTAINER SHIP WITH HULL INCORPORATING A PROPULSION SYSTEM

This application is related to U.S. patent application Ser. No. 09/214,104 filed Feb. 3, 1999.

BACKGROUND OF THE INVENTION

1. Field of the Invention

The invention relates to an autonomous container ship with a hull containing a propulsion system. This ship is able to transport containers from large ports equipped with a loading system and unload them at small ports lacking such equipment.

2. Description of the Related Art

The transport of goods is indeed one of the mainsprings of our market economy. The globalization of international trade, the development of "just in time" policies, and the increasing demand for responsiveness are continuously fostering the growth of land transport with development of costly highway infrastructures harmful to the environment.

Numerous container ships with a large container-carrying capacity and deep draft exists such as those described in Jane's Intermodal Transportation, pages 315, 338, and 341. One example of these large-capacity container ships is the ALIANCA BRASIL with a capacity of 2200 containers, a speed of 20.4 knots, a length of 200.23 m, and a draft of 12.0 m. One of the smallest of these container ships is the HERA with a capacity of 198 containers, a speed of 12.5 knots, a length of 88 m, and a draft of 4.6 m.

These container ships generally unload in ports equipped with heavy handling equipment. Ports able to receive existing container ships are few in number and cannot deliver goods close to their utilization sites.

The keels may of different types.

They may of the single-hulled type.

They may also be of the multi-hulled catamaran or trimaran type depending on whether they have two or three hulls.

Depending on specific needs, the keel may be of the mixed type known as monocatamaran, namely single-hulled at the bow and catamaran at the stern.

U.S. Pat. No. 5,038,696 describes a monocatamaran whose hull has been specially designed for hydrodynamic flow considerations under the water line to increase the speed and stability of the ship. These are the goals of the present invention, but focusing on a particular application of the type of container ship considered, namely with a large payload in relation to its displacement and stability of the ship during handling operations.

In order to increase the speed of the ship and decrease fuel costs, tunnel hulls accommodating thrusters, particularly screw propellers, have been proposed.

U.S. Pat. No. 4,371,350 discloses a ship with a thruster tunnel having a transverse configuration favorable to hydrodynamic flow along the stream lines. These concerns of improving hydrodynamic flow are found in the present invention but they are incorporated into a special architectural principle responding to the above-defined objectives.

SUMMARY OF THE INVENTION

In particular, the invention relates to a range of small and medium-sized ships that can carry merchandise from one small port to another in containers.

This range is composed of ships able to transport a maximum number of containers equal to two, four, ten, twenty, thirty, fifty, and a hundred.

A principal feature of the ship is its full autonomy, enabling it to load and/or unload containers in a port not equipped with a handling system and having a water depth of less than 4 meters.

The range of ships according to the invention arose from this view with the concern of developing complementarity between highway transport and sea/river transport.

The goal is to provide sea links to serve a multitude of inland ports that have been exploited little or not at all for goods transport. Another goal is for highway container carriers to load goods from these ports for local distribution to optimize land delivery distances.

One of the objectives of the present invention is to provide trucking companies with a mobile "sea/river superhighway" infrastructure matching the land superhighway system.

A second objective is to increase the responsiveness of sea-land transportation by shipping small quantities at frequent intervals.

A third objective is to provide river/sea service with substantial independence of maneuver, an optimized dock-to-dock path, and unloading/loading systems matching these constraints. This objective implies being able to carry a payload which is large relative to the displacement of the ship.

A fourth objective is to provide transportation under service and mileage conditions comparable to those of highways.

The purpose of the tunnels in the stem of the hull is, according to the invention:

- to build a flush-fitting propulsion system into the hull,
- to protect the propulsion elements from jolts when sailing in shallow waters,
- to improve the efficiency of the propulsion system by flow of stream lines toward the stem of the ship,
- to clear the stem of the ship so that it can come closer to the banks.

To meet the above-defined objectives, the invention relates to an autonomous container ship of the type having a keel, a propulsion system, a container loading and unloading system, and a balancing system, characterized in that the keel is of the type wherein the hull contains the propulsion system and in that the ship has a carrying system for carrying containers from large ports equipped with a container loading and unloading system to small ports lacking such equipment and having a water depth less than 4 meters. The ship includes a propulsion system that allows the ship to sail at cruising speed at sea and at estuary and port speeds, a loading and unloading system adapted to these ports lacking equipment, and a balancing system for balancing the ship at sea serving to stabilize and trim the ship during handling.

This container ship is moreover characterized in that the propulsion system also ensures maneuverability in ports.

In addition, the ship according to the invention enables a large payload relative to its displacement to be carried. This goal is achieved by equipment providing a common power supply for propulsion and handling, and a handling system usable both on board and on land.

BRIEF DESCRIPTION OF THE DRAWINGS

The attached drawings show preferred embodiments of the invention.

DETAILED DESCRIPTION OF THE PREFERRED EMBODIMENTS

The range of ships according to the invention comprises ships able to carry 2, 4, 10, 20, 30, 50, and 100 containers.

The containers are in two sizes:

20-foot containers (6.058×2.438×2.591 meters);

40-foot containers (12.116×2.438×2.591 meters).

The tonnage of the ship range according to the invention is listed in the table below:

| Number of containers | 2 | 4 | 10 | 20 | 30 | 50 | 100 |
|---|---|---|---|---|---|---|---|
| Overall Length (m) | 25 | 35 | 48 | 65 | 74 | 88 | 111 |
| Tonnage (t) | 100 | 200 | 500 | 1000 | 1500 | 2500 | 5000 |

These ships are designed on identical architectural principles. They can hence be built from modules.

The power required for operation is supplied by a diesel generator.

Propulsion is provided by a diesel engine, drive shaft plus propellers, or by hydrojets.

The propulsion system is electric-motor-driven.

The loading and unloading system is comprised of a portal crane and a ramp.

The combination of these various characteristics allows one architectural principle to be used for this range of ships.

Moreover, it must be possible to build the ship at a cost offering investors an alternative to highway transportation.

With this in mind, the technological solutions leading to economically viable solutions must have the following characteristics.

The ship must enable a large payload relative to its displacement to be carried.

The equipment must be as versatile as possible, implying a common power supply for propulsion and handling, a handling system that can be used both on board and on land, a propulsion system allowing the ship to sail at cruising speed and at estuary and port speed, and maneuverability in ports, with a balancing system that balances the ship at sea also serving to balance it during handling operations.

The range of ships according to the invention has autonomy in the following areas:

navigation: slow and rapid propulsion and navigation at sea, crew quarters: facilities enabling a crew of 3 to 5 individuals to live for several days on board, handling: a handling system enabling the ship to load and unload containers in unequipped ports, balancing: a balancing system ensures transverse stability and trim of the ship when sailing and during container handling operations.

Figure 1:
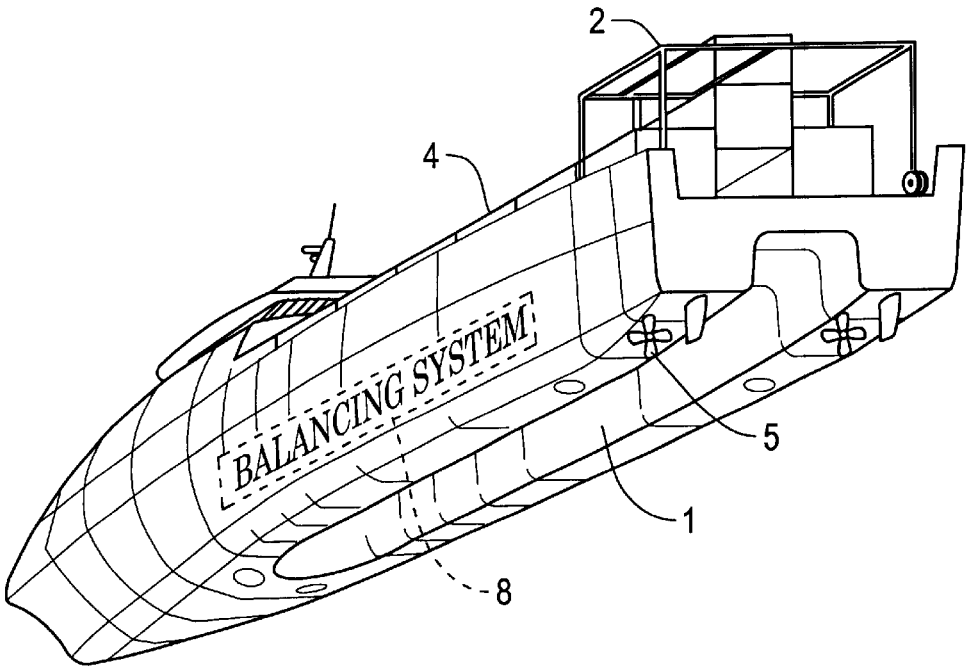
FIG. 1 is a lateral bottom view of a ship according to the invention of the monocatamaran type equipped with a portal crane.

FIG. 1 illustrates a ship according to the invention including:

a keel 1 of the single-hulled type at the bow and catamaran at the stern, a portal crane 2, containers 4, a propulsion system with propellers 5, and a balancing system 8.

The ship shown has a keel of the monocatamaran type defined above enabling it to sail at between 15 and 20 knots.

The power necessary for operation is provided by a diesel generator.

The propulsion system is comprised of an electric motor, drive shaft, and stem propellers.

According to one embodiment not shown, the propellers are replaced by hydrojets.

Handling is provided by a portal crane 2 and a ramp mounted at the stem enabling the containers to be taken on board and placed on a truck trailer at the dock.

The ship is balanced by a ballast system controlled by the stability characteristics of the ship.

The ship shown has the following characteristics:

| | |
|---|---|
| overall length | 65 m |
| width | 11 m |
| displacement at full load | 1100 t |
| draft | 2.6 m |
| number of containers | 20 |
| maximum speed | 17 knots |

Figure 2:
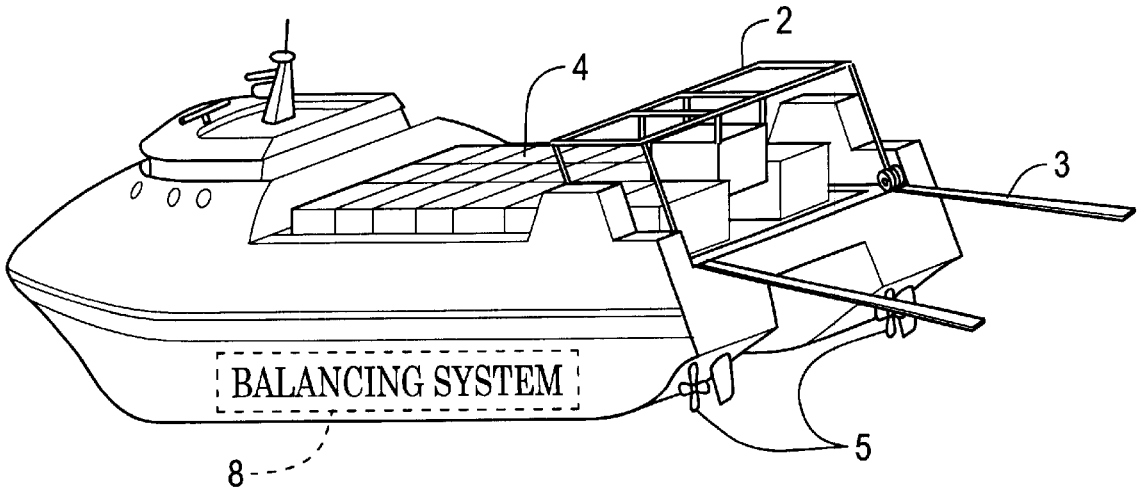
FIG. 2 is a side elevation of the same ship of the monocatamaran type equipped with a portal crane and a ramp at the stem.

FIG. 2 shows the stern-mounted handling device.

It shows a portal crane 2 and a loading and unloading ramp 3.

Portal crane 2 is driven by an electric motor accommodated in the portal crane or its wheels, and a balancing system 8.

Figure 3:
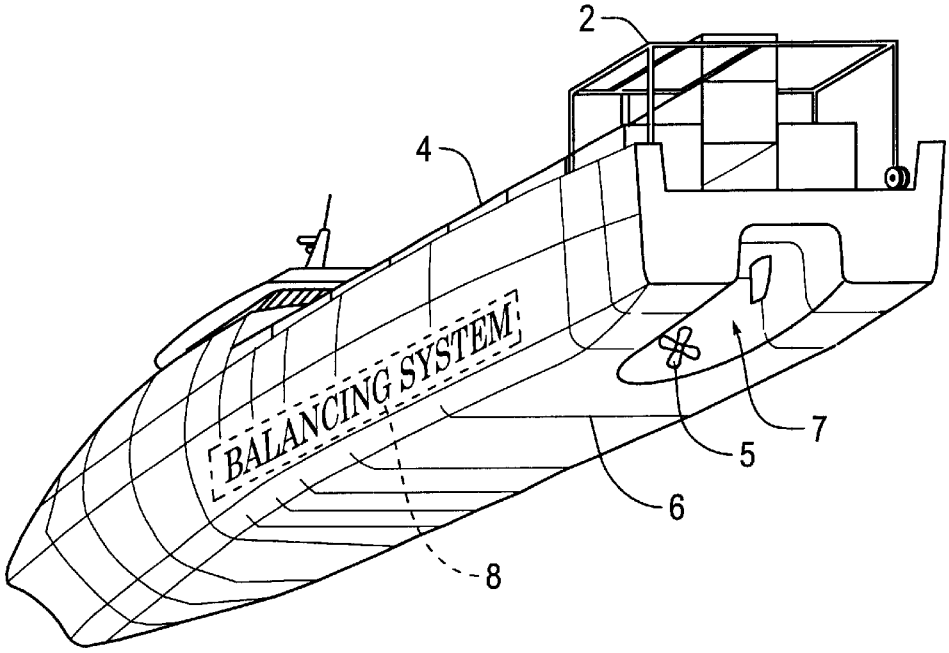
FIG. 3 is a lateral bottom view of a ship according to the invention of the single-hulled plus tunnel type.
Figure 4:
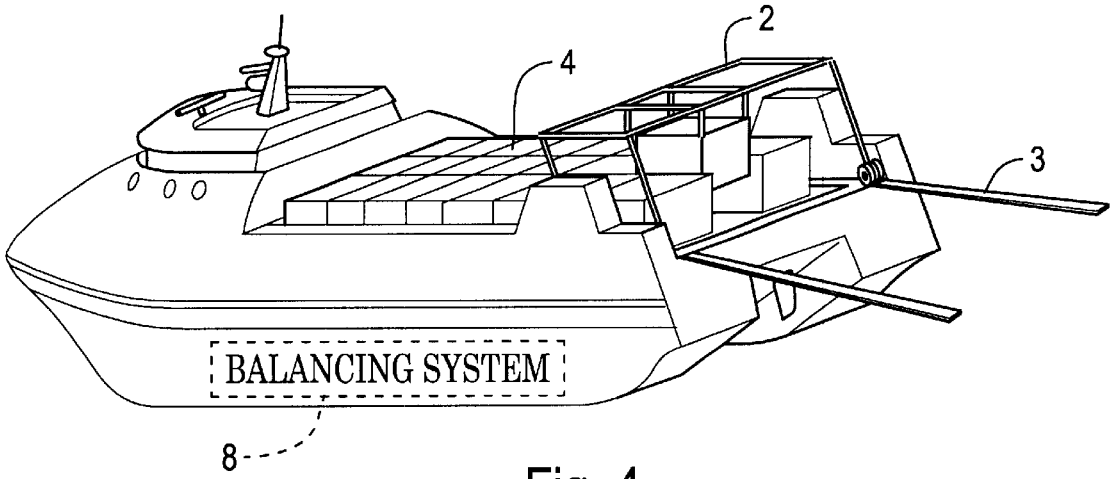
FIG. 4 is a side elevation of the same single-hulled tunnel type ship equipped with a portal crane and a ramp at the stem.

FIGS. 3 and 4 illustrate a ship according to the invention comprising:

a keel 6 of the single-hulled type with a tunnel 7 along the axis and at the stern of the keel, a portal crane 2, a ramp 3, containers 4, a propulsion system with a propeller 5, and a balancing system 8.

The tunnels of the hull in particular improve the efficiency of propulsion in shallow-water ports.

As an alternative, two or three tunnels could be considered, for installing two or three propulsion systems.

The cross section of the tunnel may be a rounded omega or pointed omega shape.

The power required for operation is supplied by a diesel generator.

The propulsion means are comprised of an electric motor, drive shaft, and a propeller at the stern.

According to one variant not shown, the propeller is replaced by a hydrojet in the tunnel.

Handling is provided by a portal crane 2 and a ramp 3 mounted at the stern.

The ship is balanced by a ballast system responding to the stability characteristics of the ship.

The ship shown has the following characteristics:

| | |
|---|---|
| overall length | 65 m |
| width | 11 m |
| displacement at full load | 1100 t |

-continued

| | |
|---|---|
| draft | 2.8 m |
| number of containers | 20 |
| maximum speed | 18 knots |

FIG. 4 shows the maintenance device mounted at the stem.

It shows a portal crane 2 and a loading and unloading ramp 3.

Portal crane 2 is driven by an electric motor accommodated in the portal crane or in the wheels thereof.

What is claimed is:

1. A self propelled container ship, comprising:

at least one propulsion and maneuvering system;

a keel having at least one recessed part, the propulsion and maneuvering system being positioned in the at least one recessed part so the ship has a draft less than four meters;

a balancing system for balancing the ship; and a powered cargo handling system movable relative to the keel and adapted to handle containers inside the ship and to move containers inside and outside the ship for loading and unloading containers, wherein the powered cargo handling system includes a motorized portal crane at a stem of the ship and a moveable ramp.

2. The container ship of claim 1, wherein the keel has at least a stern formed with the at least one recessed part.

3. The container ship of claim 2, wherein the at least one recessed part is a longitudinally extending tunnel.

4. The container ship of claim 2, wherein the propulsion and maneuvering system is contained within the at least one recessed part.

5. The container ship of claim 3, wherein the propulsion and maneuvering system is contained within the longitudinally extending tunnel.

6. The container ship of claim 5, wherein the keel comprises a single-hulled keel at the ship's bow and a double-hulled keel at the ship's stern.

7. The container ship of claim 4, wherein the keel comprises a single-hulled keel at the ship's bow and a double-hulled keel at the ship's stern.

8. The container ship of claim 1, wherein the motorized portal crane includes wheels.

9. The container ship of claim 1, wherein the at least one recessed part of the keel is formed at the stern.

10. The container ship of claim 1, wherein the powered cargo handling system is movable longitudinally at the ship's stern and outside the ship.

11. The container ship of claim 10, wherein the motorized portal crane includes wheels.

12. The container ship of claim 5, wherein the motorized portal crane is wheeled and self-propelled.

13. The container ship of claim 5, wherein the powered cargo handling system is movable longitudinally at the ship's stern and outside the ship.

14. The container ship of claim 5, wherein the motorized portal crane includes wheels.

15. The container ship of claim 4, wherein the motorized portal crane is wheeled and self-propelled.

16. The container ship of claim 4, wherein the powered cargo handling system is movable longitudinally at the ship's stern and outside the ship.

17. The container ship of claim 4, wherein the motorized portal crane includes wheels.

18. A self propelled container ship, comprising:

at least one propulsion and maneuvering system;

a keel having at least one recessed part and at least a stem formed with the at least one recessed part, the propulsion and maneuvering system being positioned in the at least one recessed part so the ship has a draft less than four meters;

a balanced system for balancing the ship; and a powered cargo handling system movable relative to the keel and adapted to handle containers inside the ship and to move containers inside and outside the ship for loading and unloading containers, wherein the powered cargo handling system includes a motorized portal crane at a stem of the ship and a moveable ramp.

* * * * *